US006249569B1

(12) United States Patent
Price et al.

(10) Patent No.: US 6,249,569 B1
(45) Date of Patent: Jun. 19, 2001

(54) X-RAY TUBE HAVING INCREASED COOLING CAPABILITIES

(75) Inventors: Michael J. Price, Brookfield; Mark O. Derakhshan, West Allis; Wayne F. Block, Sussex; Charles B. Kendall, Brookfield, all of WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/219,219

(22) Filed: Dec. 22, 1998

(51) Int. Cl.[7] ..... H01J 35/10
(52) U.S. Cl. ..... 378/130; 378/141
(58) Field of Search ..... 378/130, 127, 378/141, 144, 199, 200, 125

(56) References Cited

U.S. PATENT DOCUMENTS

| | | | | |
|---|---|---|---|---|
| 2,209,963 | * | 8/1940 | Mond | 378/125 |
| 2,290,226 | * | 7/1942 | Mond | 378/125 |
| 3,694,685 | | 9/1972 | Houston | 313/60 |
| 4,165,472 | | 8/1979 | Wittry | 313/35 |
| 4,455,504 | * | 6/1984 | Iversen | 313/30 |
| 4,622,687 | * | 11/1986 | Whitaker et al. | 378/130 |
| 4,674,109 | | 6/1987 | Ono | 378/130 |
| 4,878,235 | * | 10/1989 | Anderson | 378/125 |
| 4,945,562 | | 7/1990 | Staub | 378/130 |
| 4,969,172 | * | 11/1990 | Fengler et al. | 378/132 |
| 5,091,927 | | 2/1992 | Golitzer et al. | 378/130 |
| 5,416,820 | | 5/1995 | Weil et al. | 378/130 |
| 5,579,364 | * | 11/1996 | Osaka | 378/141 |
| 5,652,778 | | 7/1997 | Tekriwal | 378/132 |
| 5,673,301 | | 9/1997 | Tekriwal | 378/130 |
| 5,995,584 | * | 11/1999 | Bhatt | 378/144 |
| 6,021,174 | * | 2/2000 | Campbell | 378/144 |

FOREIGN PATENT DOCUMENTS

| | | | |
|---|---|---|---|
| 55-126948A | * | 10/1980 | (JP) . |
| 8-170948A | * | 12/1997 | (JP) . |
| 10-232285A | * | 9/1998 | (JP) . |
| 12-003799A | * | 1/2000 | (JP) . |

* cited by examiner

*Primary Examiner*—David P. Porta
*Assistant Examiner*—Diane I. Lee
(74) *Attorney, Agent, or Firm*—Kilpatrick Stockton LLP; Charles W. Calkins; James J. Bindseil

(57) ABSTRACT

An x-ray system with an x-ray generating device having improved heat dissipation capabilities. The x-ray generating device has an x-ray tube mounted in a casing holding a circulating, cooling medium. According to the present invention, the x-ray generating device includes a support mechanism mounted within the x-ray generating device in a manner for adjustably positioning, relative to the casing, the focal spot alignment path of generated x-rays. Additionally, the x-ray generating device includes a cooling mechanism having an inlet chamber for channeling the cooling medium within the support mechanism. Additionally, a cooling stem may be positioned within the inlet chamber to increase the heat exchange surface area exposed to the cooling medium. Thus, the present invention advantageously increases the heat dissipation capability of the x-ray generating device.

41 Claims, 4 Drawing Sheets

X-RAY TUBE HAVING INCREASED COOLING CAPABILITIES

BACKGROUND OF THE INVENTION

The present invention relates to a thermal energy management system, and more particularly, to a system for cooling an x-ray tube.

In an x-ray tube, the primary electron beam generated by the cathode deposits a very large heat load in the anode target to the extent that the target glows red-hot in operation. Typically, less than 1% of the primary electron beam energy is converted into x-rays, while the balance is converted to thermal energy. This thermal energy from the hot target is conducted and radiated to other components within the vacuum vessel of the x-ray tube. Typically, fluid circulating over the exterior of the vacuum vessel transfers some of this thermal energy out of the system. As a result of these high temperatures caused by this thermal energy, the x-ray tube components are subject to high thermal stresses which are problematic in the operation and reliability of the x-ray tube.

Typically, an x-ray beam generating device, referred to as an x-ray tube, comprises opposed electrodes enclosed within a cylindrical vacuum vessel. The vacuum vessel is typically fabricated from glass or metal, such as stainless steel, copper or a copper alloy. As mentioned above, the electrodes comprise the cathode assembly that is positioned at some distance from the target track of the rotating, disc-shaped anode assembly. Alternatively, such as in industrial applications, the anode may be stationary. The target track, or impact zone, of the anode is generally fabricated from a refractory metal with a high atomic number, such as tungsten or tungsten alloy. Further, to accelerate the electrons, a typical voltage difference of 60 kV to 140 kV is maintained between the cathode and anode assemblies. The hot cathode filament emits thermal electrons that are accelerated across the potential difference, impacting the target zone of the anode at high velocity. A small fraction of the kinetic energy of the electrons is converted to high energy electromagnetic radiation, or x-rays, while the balance is contained in back scattered electrons or converted to heat. The x-rays are emitted in all directions, emanating from the focal spot, and may be directed out of the vacuum vessel along a focal spot alignment path. In an x-ray tube having a metal vacuum vessel, for example, an x-ray transmissive window is fabricated into the metal vacuum vessel to allow the x-ray beam to exit at a desired location. After exiting the vacuum vessel, the x-rays are directed along the focal spot alignment path to penetrate an object, such as human anatomical parts for medical examination and diagnostic procedures. The x-rays transmitted through the object are intercepted by a detector or film, and an image is formed of the internal anatomy. Further, industrial x-ray tubes may be used, for example, to inspect metal parts for cracks or to inspect the contents of luggage at airports.

Since the production of x-rays in a medical diagnostic x-ray tube is by its nature a very inefficient process, the components in x-ray generating devices operate at elevated temperatures. For example, the temperature of the anode focal spot can run as high as about 2700° C., while the temperature in the other parts of the anode may range up to about 1800° C. Additionally, the components of the x-ray tube must be able to withstand the high temperature exhaust processing of the x-ray tube, at temperatures that may approach approximately 450° C. for a relatively long duration. The thermal energy generated during tube operation is typically transferred from the anode, and other components, to the vacuum vessel. The vacuum vessel is typically enclosed in a casing filled with circulating, cooling fluid, such as dielectric oil, that removes the thermal energy from the x-ray tube. The casing additionally supports and protects the x-ray tube and provides for attachment to a structure for mounting the tube. Also, the casing is lined with lead to provide stray radiation shielding.

The high operating temperature of an x-ray tube are problematic for a number of reasons. The exposure of the components of the x-ray tube to cyclic, high temperatures can decrease the life and reliability of the components. In particular, the anode assembly is typically rotatably supported by a bearing assembly. The bearing assembly is very sensitive to high heat loads. Overheating the bearing assembly can lead to increased friction, increased noise, and to the ultimate failure of the bearing assembly. Also, because of the high temperatures, the balls of the bearing assembly are typically coated with a solid lubricant. A preferred lubricant is lead, however, lead has a low melting point and is typically not used in a bearing assembly exposed to operating temperatures above 400 degrees Celsius. Also, because of this temperature limit, a tube with a bearing assembly having a lead lubricant is typically limited to shorter, less powerful exposures. Above 400 degrees Celsius, silver is usually the lubricant of choice. Silver allows for longer, more powerful exposures. Silver is not as preferred as lead, however, because it increases the noise generated by the bearing assembly.

Another problem with high temperature within an x-ray tube is that it reduces the duty cycle of the tube. The duty cycle is a factor of the maximum operating temperature of the tube. The operating temperature of an x-ray tube is a factor of the power and length of the x-ray exposure, and also the time between exposures. Typically an x-ray tube is designed to operate at a certain maximum temperature, corresponding to a certain heat capacity and heat dissipation capability for the components within the tube. These limits are generally designed with current x-ray exposure routines in mind. New exposure routines are continually being developed, however, and these new routines may push the limits of current x-ray tube capabilities. Techniques utilizing higher x-ray power and longer exposures are in demand in order to provide better images. Thus, there is an increasing demand to remove as much heat as possible from the x-ray tube, as quickly as possible, in order to increase the x-ray exposure power and duration before reaching the operational limits of the tube.

The prior art has primarily relied on removing thermal energy from the x-ray tube through the cooling fluid circulating about the vacuum vessel. This approach may be satisfactory in some applications where the anode end of the tube can be sufficiently exposed to the circulating fluid. It has been found that this approach is not satisfactory, however, in x-ray tubes where exposure to the anode end is limited, such as due to mounting and adjustment mechanisms. Mounting and adjustment mechanisms are desired on x-ray tubes to adjustably control the position of the focal spot alignment path to meet system specifications. Often, the system requirements for the focal spot alignment path are very tight, thereby making the ability to make adjustments highly advantageous. These mechanisms allow the focal spot alignment path to be linearly and/or rotationally moved relative to the casing. These mechanisms are beneficial in that the focal spot alignment path can be set easily, quickly and cheaply at the time of manufacturing and assembling the x-ray tube and casing. In contrast, some x-ray tubes are hard mounted to the casing. In these hard mounted tubes, precise machining of the mating tube and casing are required to get a proper focal spot alignment path. Further, once the tube and casing are assembled, the only way to adjust the focal spot alignment path is by adjusting the positioning of the casing on the x-ray system on which it is mounted. This is often a cumbersome task, and it is typically a more expensive task as this is often performed by service technicians at a customer site.

Other methods have sought to aid in removing heat from an x-ray tube by circulating a cooling fluid through multiple, hollow chambers in the shaft of the anode assembly. These approaches are not totally successful, however, in that they generally do not utilize the incoming flow of cooling medium to remove heat from the x-ray tube components. Additionally, these anode-cooling methods are typically limited to hard mounted x-ray tubes, as it is difficult to integrate this type of additional cooling with an adjustably mounted tube.

BRIEF SUMMARY OF THE INVENTION

The present invention provides for increased anode cooling of an adjustably mounted x-ray tube. According to the present invention, an x-ray generating device comprises a target positioned for receiving electrons at a focal spot, resulting in generating x-rays. The x-rays exit said x-ray generating device along a focal spot alignment path. A support mechanism has the target mounted thereon. The support mechanism is typically disposed about a central, longitudinal axis and has a proximal end and a distal end. The target is rotatably mounted to the distal end, and the support mechanism is mounted within the x-ray generating device in a manner for adjustable positioning of the focal spot alignment path. A cooling mechanism for channeling a cooling medium is at least partially positioned within said support mechanism. The cooling mechanism is disposed adjacent to the proximal end of said support mechanism. The cooling mechanism comprises a hollow portion having an outer surface and an inner surface, and the inner surface forms an inlet chamber for receiving the cooling medium.

Additionally, the proximal end of the support mechanism may further comprise a cooling stem and a housing. The cooling stem comprises an outer surface and the housing comprises an inner surface. The combination of the outer surface of the cooling stem and the inner surface of the housing forming an annular chamber. Preferably, the cooling stem projects into the inlet chamber. The combination of the inner surface of the housing and the outer surface of the cooling mechanism form an outlet chamber for receiving the cooling medium. The outlet chamber is in communication with the inlet chamber. The inlet chamber, the outlet chamber and the cooling medium comprise a cooling system suitable to increase the heat dissipation capability of the x-ray system ups to about 30%, preferably about 10% to 30%.

DETAILED DESCRIPTION OF THE INVENTION

Figure 1:
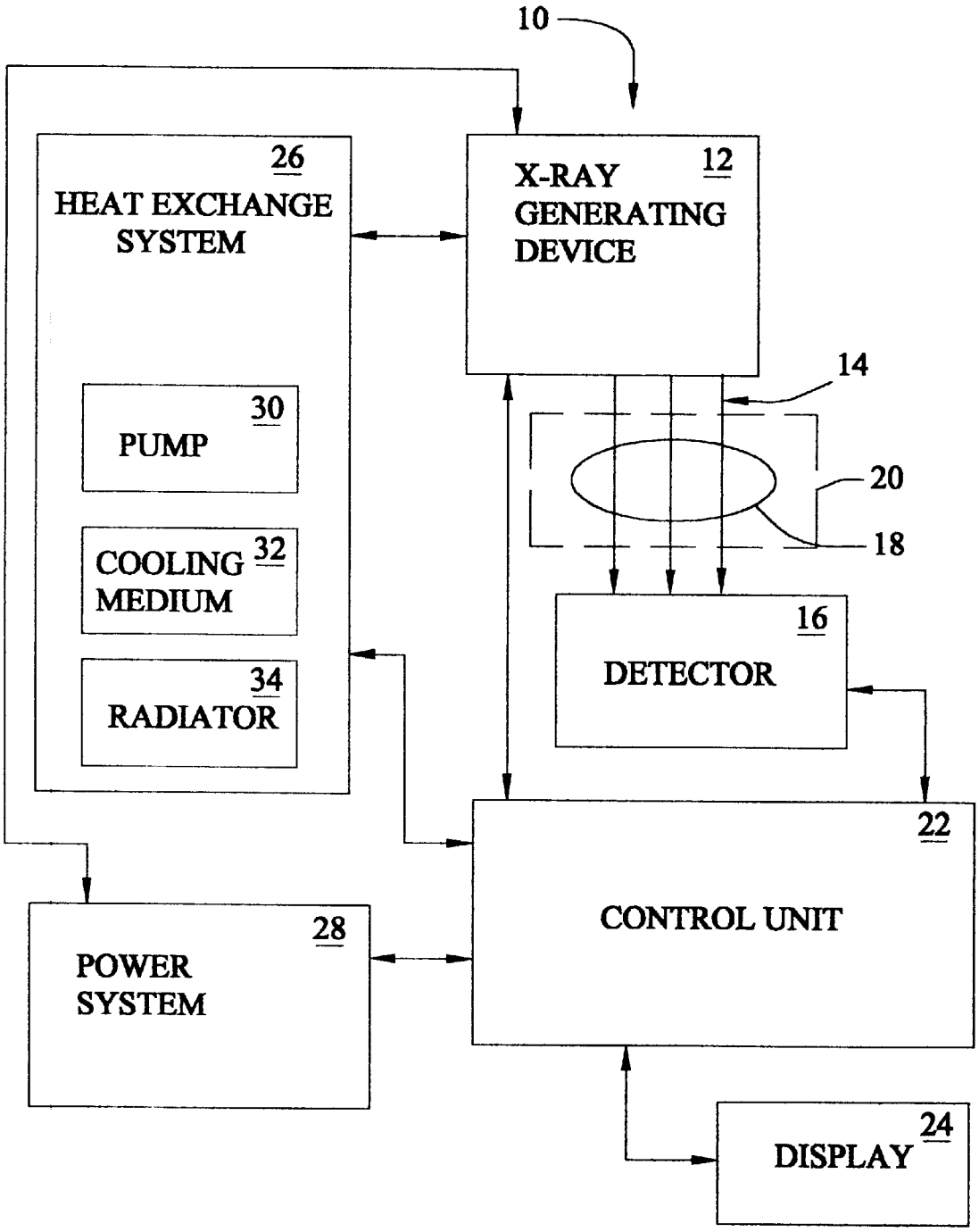
FIG. 1 is a schematic representation of the system of the present invention.

Referring to FIG. 1, according to the present invention, x-ray system 10 comprises x-ray generating device 12 producing an adjustable path of x-rays 14 and having improved heat transfer capabilities. X-rays 14 are received by detector 16 to produce an image of object 18, such as human anatomy, within imaging volume 20. Detector 16 may comprise a device that converts the received x-rays 14 to an electrical signal that is forwarded to control unit 22, which reconstructs the electrical signals into an image that may be exhibited on display 24, such as a video monitor. Alternatively, detector 16 may comprise radiographic film that is developed to produce the image. Control unit 22, comprising a computer device, is also used to operate x-ray generating device 12 and the associated heat exchange system 26 and power system 28. Heat exchange system 26 comprises pump 30 circulating a cooling medium 32, such as dielectric oil or other similar fluid, through x-ray generating device 12. Heat exchange system 26 further comprises radiator 34 that removes heat transferred to cooling medium 32 from x-ray generating device 12. Power system 28 provides electrical connections in communication with x-ray generating device 12 to energize the system. X-ray system 10 may comprise imaging systems for vascular, fluoroscopy, angiography, radiography, mammography, computed tomography and mobile x-ray imaging, and other similar systems.

Figure 2:
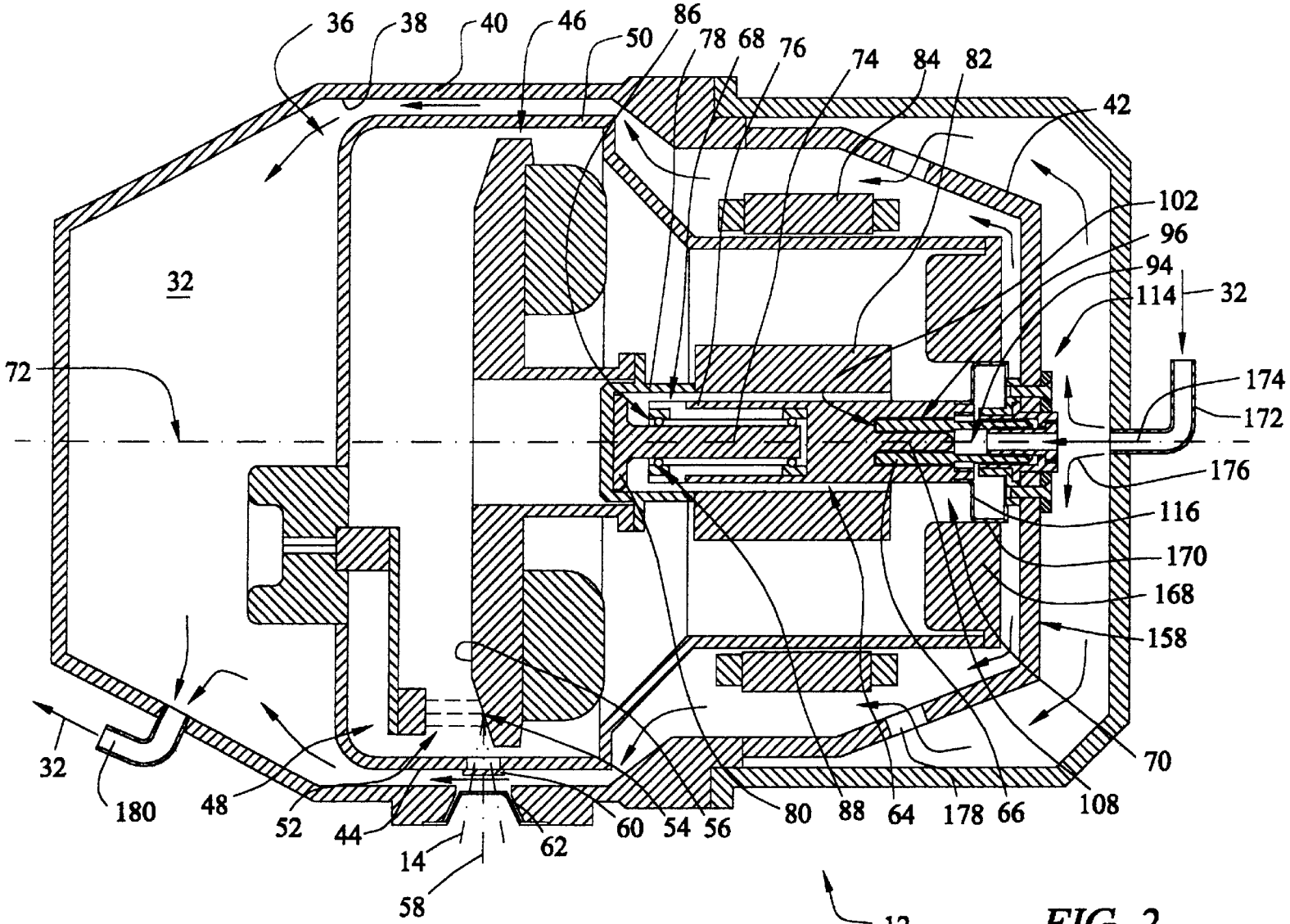
FIG. 2 is a cross-sectional view of one embodiment of an x-ray generating device according to the present invention.
Figure 3:
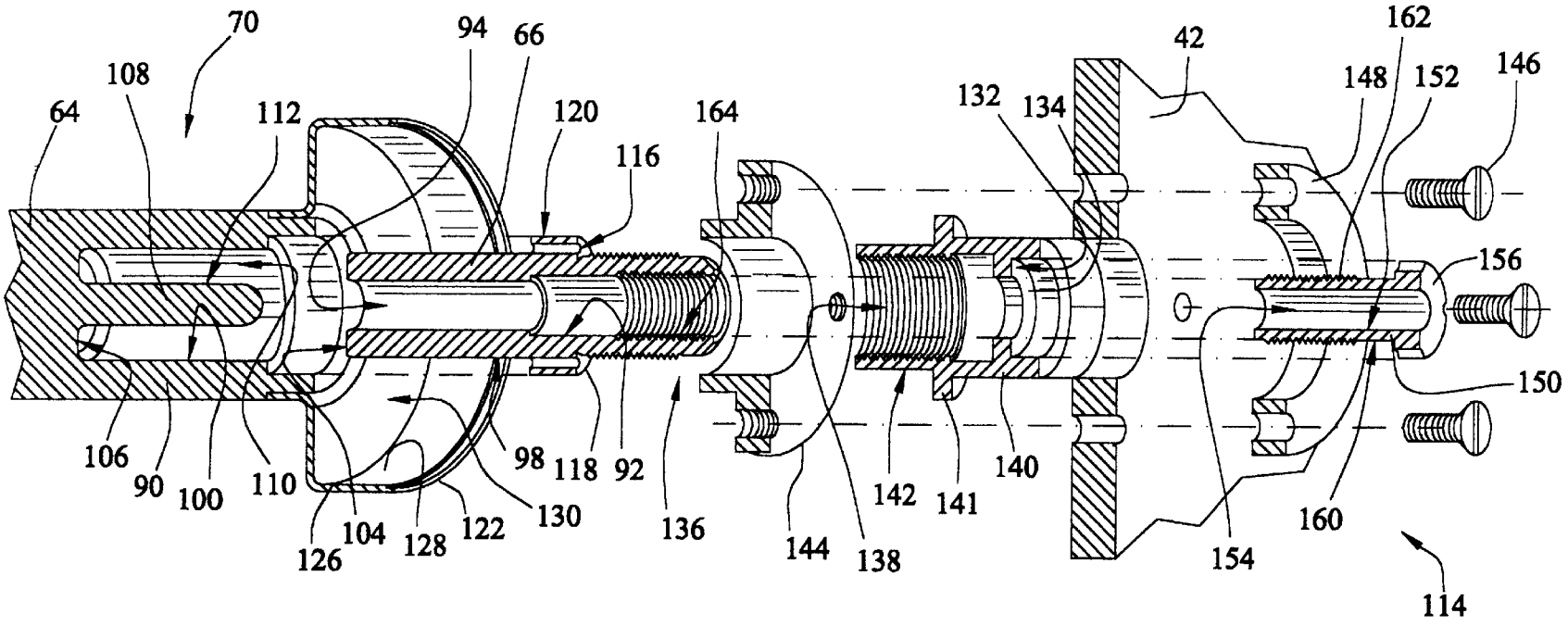
FIG. 3 is a an enlarged, exploded cross-sectional view of the present invention.
Figure 5:
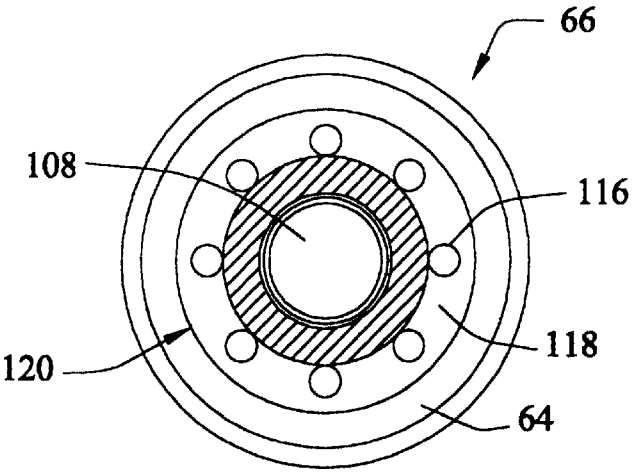
FIG. 5 is a sectional view of the present invention along line 5—5 in FIG. 4.

Referring to FIG. 2, x-ray generating device 12 comprises x-ray tube 36 adjustably positioned within chamber 38 of casing 40. X-ray tube 36 is adjustably attached to mounting device 42, which supports the x-ray tube through a fixed attachment to casing 40. Additionally, chamber 38 contains cooling medium 32 that circulates about exterior surface 44 of x-ray tube 36 to remove heat generated within the x-ray tube. X-ray tube 36 further comprises anode assembly 46 and cathode assembly 48 disposed in a vacuum within vessel 50. Upon energization of the electrical circuit of power system 28 (FIG. 1) connecting cathode assembly 48 and anode assembly 46, a stream of electrons 52 are directed through the vacuum and accelerated toward the anode assembly. The stream of electrons 52 strike focal spot 54 on a preferably rotating, disc-like target 56 on anode assembly 46 and produce high frequency electromagnetic waves 14, or x-rays, and residual energy. The residual energy is absorbed by the components within x-ray generating device 12 as heat. X-rays 14 are directed through the vacuum, along focal spot alignment path 58, and out of x-ray tube 36 through first window 60. Similarly, x-rays 14 continue through cooling medium 32 circulating between vessel 50 and casing 40, and out of x-ray generating device 12 through a second window 62 disposed in the wall of the casing. Windows 60 and 62 comprise a material that efficiently allows the passage of x-rays 14, such as beryllium, titanium or aluminum. Casing 40 typically comprises aluminum, while suitable materials for vessel 50 include stainless steel, copper and glass. Thus, x-rays 14 are directed out of x-ray generating device 12 along a focal spot alignment path 58 toward detector 16 (FIG. 1).

X-ray generating device 12 of the present invention advantageously allows for the adjustable positioning of focal spot alignment path 58 relative to casing 40, for improved cooling of anode assembly 46, and for reliable mechanical support of x-ray tube 36 through the use of support mechanism 64 and cooling mechanism 66 in combination with mounting device 42. The use of mounting device 42 is advantageous because it provides mechanical support to reliably affix x-ray tube 36 within casing. Mounting device 42 allows x-ray generating device 12 to be oriented at any position in x-ray system 10 while maintaining a fixed, relative position between x-ray tube 36 and casing 40. Additionally, mounting device 42 typically comprises an adjusting mechanism, as is discussed in detail below, that beneficially allows focal spot alignment path 58 to be rotationally and linearly positioned relative to casing 40. This positioning capability is important to allow x-ray tube 36 to have focal spot alignment path 58 located within the specifications set for x-ray system 10. The use of a mechanical support like mounting device 42 is typically disadvantageous from a heat dissipation perspective, however, as it reduces access of cooling medium 32 to anode assembly 46. The reduced access of cooling medium 32 to anode assembly 46 and its components thereby reduces heat transfer from the anode assembly to the cooling medium. In contrast, the present invention synergistically integrates support mechanism 64, cooling mechanism 66 and mounting device 42 to provide a channel that allows the flow of cooling medium 32 to be directly exposed to anode assembly 46. Thus, the present invention allows the benefits of having an adjustably positionable focal spot alignment path 58 and reliable mechanical support of x-ray tube 36 to be combined with the advantages of increased thermal energy transfer from anode assembly 46.

As a result, the continuous heat dissipation capability of x-ray tube 36 is increased. Correspondingly, the operating temperature of anode assembly 46, and particularly support mechanism 64 and its associated bearing components, is proportionally reduced. Further, the cooling capability of cooling medium 32 at the proximal end of anode assembly 46 is increased proportionally to the additional heat exchange surface area created by the flow channel within the anode assembly. Therefore, the present invention allows x-ray tube 36 to be operated for longer durations at higher powers, advantageously increasing the quality of the diagnostic imaging, improving patient throughput, and hence the overall economy of the system.

Referring to FIGS. 2–5, support mechanism 64 and cooling mechanism 66 may be considered to be portions of anode assembly 46. Support mechanism 64 is a fixed base that supports rotating target 56. Support mechanism 64 preferably comprises a shaft, having distal end 68 and proximal end 70, disposed about a longitudinal, central axis 72 within vacuum vessel 50. Suitable materials for support mechanism 64 comprise copper, Glidcop™ alloy available from SCM Metals in Belgium, stainless steel, beryllium, and other similar high thermal conductivity and high temperature capability materials. Shaft 74 is rotatably fixed within bearing housing 76 at distal end 68 of support mechanism 64. Target 56 is fixedly attached to shaft 74 through thermal barrier 78 and hub 80 formed at the end of the shaft. Thermal barrier 78 comprises a material having a low thermal conductivity in order to insulate the rest of anode assembly 46 from the hot, rotating target 56. Further, shaft 74 is fixedly attached to rotor 82 through hub 80 and thermal barrier 78, forming a tubular skirt encompassing support mechanism 64. Rotor 82 in combination with stator 84, positioned over anode assembly 46 outside of vacuum vessel 50, comprises wire windings that form an electromagnetic motor that rotate target 56 upon energization. Additionally, bearing assembly 86 for providing rotational support for shaft 74 is removably fixed within housing 76 at distal end 68 of support mechanism 64. Bearing assembly 86 preferably comprises a front and a rear bearing set. Each bearing set comprises a plurality of ball bearings positioned between an outer race and an inner race. The inner race is preferably formed, such as by machining, on shaft 74. Additionally, bearing assembly 86 comprises solid lubricant 88 to reduce friction and noise within the bearing assembly. Solid lubricant 88 is preferably a coating layer on the exterior surface of the ball bearings. Suitable materials for lubricant 88 include silver and lead.

Cooling mechanism 66 for transferring heat from anode assembly 46 is preferably disposed along central axis 72 on the opposite end of support mechanism 64 from target 56. Cooling mechanism 66 is positioned within, and extends from, proximal end 70 of the stationary support mechanism 64. Cooling mechanism 66 comprises a hollow, tube-like member having an inner surface 92 that forms an inlet chamber 94 suitable for receiving cooling medium 32. Suitable materials for cooling mechanism 66 comprise stainless steel, copper, Glidcop™ alloy, and other similar materials. Additionally, outlet chamber 96 is formed between outer surface 98 of cooling mechanism 66 and inner surface 100 of housing 90. Outlet chamber 96 further comprises passages 116 formed in flange 118 extending radially outward from cooling mechanism 66. Outlet chamber 96, inlet chamber 94, and return chamber 102, which joins the outlet and inlet chambers and is formed between the end face 104 of cooling mechanism 66 and the inside face 106 of housing 90, advantageously form a channel for allowing the thin film of cooling medium 32 to flow through anode assembly 46. Inlet chamber 94, return chamber 102 and outlet chamber 96 thereby provide cooling medium 32 with access to a heat exchange surface area within support mechanism 64. This heat exchange surface area comprises inner surface 100 and inside face 106 of housing 90. Thus, the present invention directly exposes cooling medium 32 to heat exchange surface areas within support mechanism 64 for the transfer of thermal energy from anode assembly 46 to the cooling medium and out of the system.

In order to beneficially increase the available heat exchange surface area, and therefore increase the heat dissipation capability of x-ray tube 36, support mechanism 64 of the present invention advantageously provides cooling stem 108 projecting into housing 90. An annular chamber 110 is thereby formed between inner surface 100 of housing 90 and outer surface 112 of cooling stem 108. Preferably, one end of cooling mechanism 66 is positioned within annular chamber 110 such that cooling stem 108 extends into inlet chamber 94. Outer surface 112 of cooling stem 108 thereby advantageously provides supplementary heat exchange surface area within inlet chamber 94 to transfer thermal energy to cooling medium 32. The extra heat exchange surface area provided by cooling stem 108, in addition to the heat exchange surface area provided by inside face 106 and inner surface 100 of housing, thereby increases the thermal energy transferred to cooling medium 32 for a given x-ray exposure. The increased thermal energy transfer results in reduced operating temperatures within anode assembly 46, which advantageously reduces noise and increases reliability, life span and performance. Thus, cooling mechanism 66 and cooling stem 108 provide increased heat dissipation capabilities in proportion to the increased heat exchange surface area in contact with cooling medium 32.

Cooling mechanism 66 and support mechanism 64 are fixed relative to each other, but adjustably positionable relative to mounting device 42 through adjustment mechanism 114, such as a collet assembly. Support mechanism 64 is fixedly attached to cooling mechanism 66 through flange 118. Flange 118 comprises outer surface 120 fixedly attached, such as by brazing or welding, to outer surface 98 of cooling mechanism 66. Cooling mechanism 66 is adjustably fixed to adjustment mechanism 114 and mounting device 42. Adjustment mechanism 114 provides movable positioning of cooling mechanism 66 linearly along central axis 72 and rotationally about the central axis. Once x-ray tube 36 is properly positioned, adjustment mechanism 114 fixedly attaches cooling mechanism 66 to mounting device 42 to prevent relative movement of the x-ray tube within casing 40. The components of adjustment mechanism 114 are discussed in more detail below. Thus, the combination of mounting device 42 and adjustment mechanism 114 adjustably position x-ray tube 36, and hence focal spot alignment path 58, relative to casing 40.

Further, sleeve 122 is utilized for hermetically sealing support mechanism 64 to vacuum vessel 50. Also, sleeve 122 is used to direct the flow of cooling medium 32 flowing out of outlet chamber 96. The vacuum is maintained in vessel 50 by hermetic seals joining the proximal end of the vessel to sleeve 122 through insulator 168. Insulator 168 comprises a non-electrically conducting material such as plastic. The outer surface of insulator ring 168 is hermetically sealed to vessel 50, and the inner surface is hermetically sealed to seal ring 170. Seal ring 170 is fixedly attached to insulator ring 168 and to sleeve 122, such as by brazing or welding. Sleeve 122, in turn, is fixedly attached, such as by brazing or welding, to support mechanism 64. Suitable materials for seal ring 170 and sleeve 122 comprise stainless steel, Kovar® alloy available from Westinghouse Electric & Manufacturing Company, and other similar materials. As a result, the vacuum within vessel 50 is maintained and the entire x-ray tube 36 is movable relative to casing 40 and mounting device 42 by adjustment mechanism 114.

Sleeve 122 comprises housing 126 having interior surface 128 forming proximal chamber 130. Chamber 130 is in communication with, and forms a part of, outlet chamber 96 through passages 116 in flange 118. Chamber 130 in sleeve 122 forms an annular chamber as it is intersected by cooling mechanism 66 and the components of adjustment mechanism 114.

To adjust the position of focal spot alignment path 58 linearly along central axis 72, adjustment screw 140 is rotated relative to cooling mechanism 66. Outer surface 98 at proximal end 136 of cooling mechanism 66 includes threads that correspond to a threaded portion within inner bore 138 of adjustment screw 140. Adjustment screw 140 further comprises external flange 141 that abuts the interior surface of mounting device 42. Thus, the relative rotation of adjustment screw 140 and cooling mechanism 66 provide linear translation of the entire x-ray tube 36 relative to mounting device 42.

Once the proper linear position of focal spot alignment path 58 is achieved, locking device 150 is utilized to fix the relative position of adjustment screw 140 and cooling mechanism 66. Locking device 150 comprises outer surface 160 having threaded portion 162 engaging a corresponding threaded portion 164 of inner surface 92 of cooling mechanism 66. The relative rotation of locking device 150 within cooling mechanism 66 results in clamping head 156 of locking device 150 against proximal surface 132 on inner flange 134 of adjustment screw 140. As a result, the relative positions of adjustment screw 140 and cooling mechanism 66 are fixed.

To adjust the position of focal spot alignment path 58 rotationally about central axis 72, x-ray tube 36 is rotated relative to mounting device 42. Outer surface 142 of adjustment screw 140 is movable within bores through adjustment guide 144 and mounting device 42. Thus, with the relative position of adjustment screw 140 and cooling mechanism 66 fixed by locking device 150, the entire x-ray tube 36 can be rotationally positioned. Upon achieving the desired rotational position for focal spot alignment path 58, adjustment guide 144 and external flange 141 of adjustment screw 140 are clamped to mounting device 42 by retaining device 146, such as screws. Screws 146, each having a threaded portion, are positioned through holes in clamp plate 148, through holes in mounting device 42, and engage adjustment guide 144. Preferably, adjustment guide 144 and screws 146 have corresponding thread patterns that allow the adjustment guide and adjustment screw 140, upon relative rotation, to clamp to mounting device 42. Thus, screws 146 and adjustment guide 144 can be loosened, allowing x-ray tube 36 to be rotated to align the position of focal spot alignment path 58, and then tightened to secure the position.

Therefore, adjustment screw 140, adjustment guide 144, retaining device 146, clamp plate 148 and locking device 150 all comprise a part of adjustment mechanism 114. A suitable material for adjustment mechanism 114 comprises stainless steel, for example, while a suitable material for mounting device 42 comprises Ultem® plastic available from General Electric Company, for example.

Therefore, adjustment mechanism 114 provides cantilevered support for the anode assembly within vacuum vessel 50. Adjustment mechanism 114 enables the adjustable positioning of focal spot alignment path 58 relative to casing 40, including linear positioning along longitudinal, central axis 72 and rotational positioning about the central axis. Adjustment mechanism 114 advantageously allows focal spot alignment path 58 to be positioned to meet predetermined specifications. This positioning is preferably performed at the time of manufacturing and assembling x-ray generating device 12, as opposed to at a customer site, thereby reducing the cost of setting up the x-ray generating device. Additionally, the adjustable positioning of focal spot alignment path 58 provided by the present invention is advantageous over a fixed mounting method, where precise machining of the mating surfaces of x-ray tube 36 and casing 40 is required to insure the fixed mounting produces a focal spot alignment path within specifications.

Locking device 150 further comprises a hollowed-out collet bolt or screw positioned through mounting device 42 along central axis 72. Locking device 150 comprises an inner surface 152 forming chamber 154. Chamber 154 of locking device 150 and inner bore 138 of adjustment screw 140 are each in communication with and form a part of inlet chamber 94.

Figure 4:
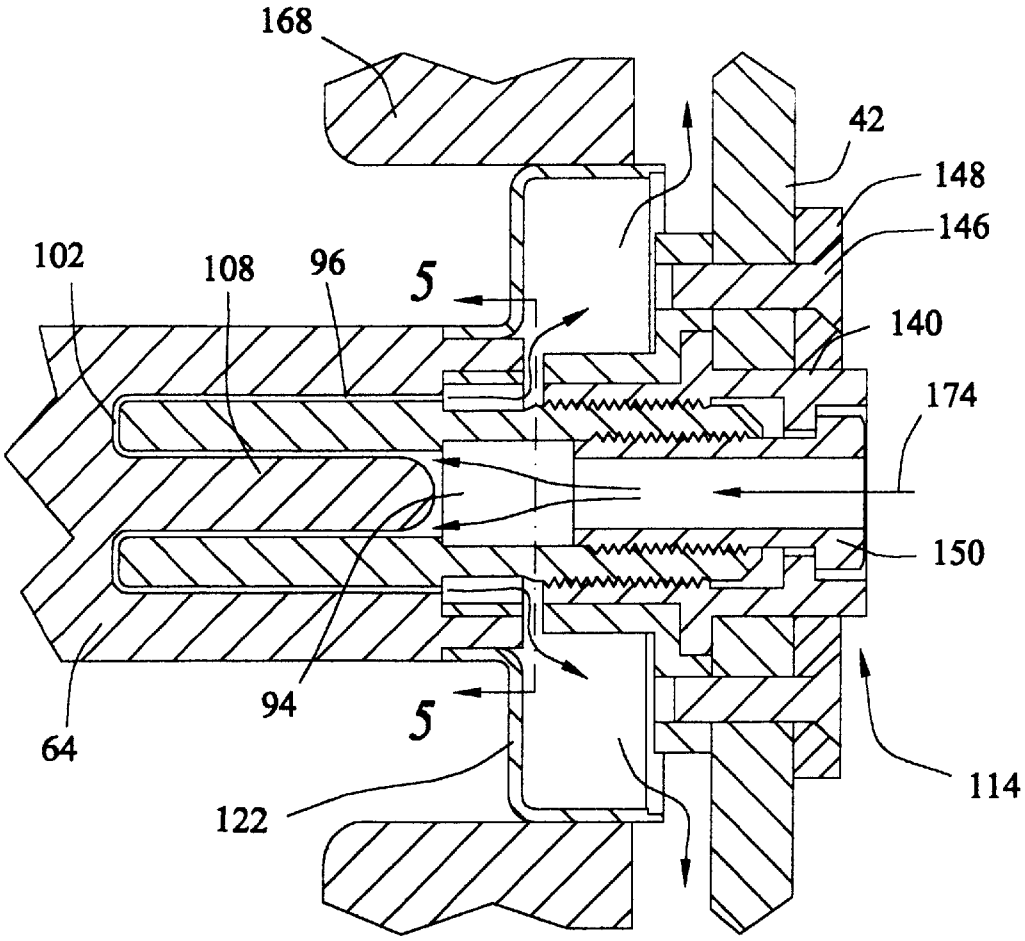
FIG. 4 enlarged cross-sectional view of the present invention.

In operation, referring to FIGS. 2 and 4, x-ray tube 36 is cooled by the circulation of cooling medium 32 within casing 40 and around the x-ray tube. Cooling medium 32 is fed to casing 40 from heat exchange system 26 (FIG. 1) through inlet fixture 172, which includes typical pipe fittings and may include a nozzle (not shown) for accelerating and directing the cooling medium. A first portion 174 of cooling medium 32 fed into casing 40 is directed to flow into cooling mechanism 66 through the hollow locking device 150. First portion 174 of cooling medium 32 flows in the direction of distal end 68 of support mechanism 64 through inlet chamber 94. Preferably first portion 174 of cooling fluid 32 flows around cooling stem 108, thereby extracting heat from support mechanism 64 and thus from anode assembly 46. It is believed that the flow, however, is not a turbulent flow. The flow of first portion 174 of cooling medium 32 around cooling stem 108 provides a thin-film flow that affects the boundary layer, increasing the heat transfer coefficient.

The thin-film flow channel provided by cooling stem 108 within inlet chamber 94 advantageously produces a heat transfer coefficient in the range of about 800–1200 W/m$^{2}$° C., preferably in the range of about 950–1050 W/m$^{2}$° C. In contrast, the heat transfer coefficient in a non-thin film flow layer (i.e. a wide inlet chamber) is in the range of about less than 300 W/m$^{2}$° C. Thus, the present invention beneficially improves the heat transfer coefficient between anode assembly 46 and cooling medium 32, and more particularly between support mechanism 64 and cooling medium 32, by as much as 3:1.

The flow of first portion 174 of cooling medium 32 continues radially outward through return chamber 102 and toward proximal end 70 of support mechanism 64 through outlet chamber 96, extracting more heat from anode assembly 46 through the heat exchange surface areas. First portion 174 of cooling medium 32 flows out of cooling mechanism 66 through proximal chamber 130 of sleeve 122.

The exposure of cooling medium 32 to heat exchange surface areas within support mechanism 64 advantageously provides an increase in the heat dissipation capability between anode assembly 46 and cooling medium 32 compared to prior art, closed ended systems. The increase in heat dissipation capability is proportional to the heat exchange surface area. For example, inlet chamber 94, return chamber 102 and outlet chamber 96 provide a flow channel for cooling medium 32 to interact with support mechanism 64, providing a heat dissipation capability increased by up to about 30%, preferably 10%–30%.

The thin-film portions of inlet chamber 94, return chamber 102 and outlet chamber 96 are of a sufficient thickness to maximize the heat transfer coefficient between the heat exchange surface areas to first portion 174 of cooling medium 32. Generally, increasing the heat transfer coefficient must be balanced with the pressure drop created by narrowing chambers 94, 102 and 96. The chambers can be narrowed too far, causing a pressure drop that reduces the flow to the point that the heat transfer coefficient is reduced. Thus, chambers 94, 102 and 96 are sized to affect the boundary layer of cooling medium 32 and provide a sufficient pressure drop that maximizes the heat transfer coefficient between the heat exchange surface areas within the chambers and the cooling medium 32.

Meanwhile, the part of cooling medium 32 that does not enter inlet chamber 94, referred to as second portion 176, is directed around exterior surface 158 of mounting device 42. As first portion 174 flows between insulator ring 168 and mounting device 42, the first portion converges with second portion 176 flowing around exterior surface 158 of the mounting device as cooling medium 32 flows through a plurality of through-holes 178 disposed around the perimeter of the mounting device. Cooling medium 32 continues to flow through the windings of stator 84, around the end of x-ray tube 36 that houses cathode assembly 48, and out of casing 40 through outlet fixture 180. Outlet fixture 180 returns cooling medium 32 to heat exchange system 26 (FIG. 1). Thus, inlet chamber 94, return chamber 102, outlet chamber 96 and cooling medium 32 comprise a cooling system suitable to increase the heat dissipation capability at anode assembly 46, and more particularly at support mechanism 64, by up to about 30%, and preferably from about 10% to 30%.

In summary, one feature of the present invention is to provide an x-ray system having an x-ray generating device with improved thermal performance and duty cycle by preferentially increasing the cooling capability within the anode assembly. Another feature of the present invention preferably combines the ability of focal spot alignment path adjustment with the above-described cooling capability. Another feature of the present invention beneficially increases the heat exchange surface area exposed to the cooling medium to further increase the cooling capability. Thus, especially with the rising demand for increased power and duration of x-ray exposures, the present invention provides a solution to remove more thermal energy, or heat, from an x-ray tube within an x-ray generating device.

Although the invention has been described with reference to these preferred embodiments, other embodiments can achieve the same results. Variations and modifications of the present invention will be apparent to one skilled in the art and the following claims are intended to cover all such modifications and equivalents.

What is claimed is:

1. An x-ray generating device, comprising:

a target positioned for receiving electrons at a focal spot resulting in generating x-rays, said x-rays exiting said x-ray generating device along a focal spot alignment path;

a support mechanism having said target mounted thereon, said support mechanism disposed about a central, longitudinal axis and having a proximal end and a distal end, said target rotatably mounted to said distal end, and said support mechanism mounted within said x-ray generating device in a manner for adjustable positioning of said focal spot alignment path; and a cooling mechanism for channeling a cooling medium within said support mechanism, said cooling mechanism disposed adjacent to said proximal end of said support mechanism, said cooling mechanism comprising a hollow portion having an outer surface and an inner surface, and said inner surface forming an inlet chamber for receiving said cooling medium.

2. An x-ray generating device as recited in claim 1, wherein said proximal end of said support mechanism further comprises a cooling stem and a housing, wherein said cooling stem comprises an outer surface and said housing comprises an inner surface, the combination of said outer surface of said cooling stem and said inner surface of said housing forming an annular chamber.

3. An x-ray generating device as recited in claim 2, wherein said cooling stem projects within said inlet chamber.

4. An x-ray generating device as recited in claim 2, wherein said cooling stem and said inlet chamber are centered about said central, longitudinal axis.

5. An x-ray generating device as recited in claim 1, wherein said cooling mechanism is at least partially disposed within said housing of said support mechanism, the combination of said inner surface of said housing and said outer surface of said cooling mechanism forming an outlet chamber for receiving said cooling medium, said outlet chamber being in communication with said inlet chamber.

6. An x-ray generating device as recited in claim 5, wherein said inlet chamber, said outlet chamber and said cooling medium comprise a cooling system suitable to increase the heat dissipation capability of said support mechanism in the range of greater than 0% to about 30% above the heat dissipation capability of non-cooled anode x-ray devices.

7. An x-ray generating device as recited in claim 1, wherein a heat transfer coefficient between said cooling stem and said cooling medium is in the range of about 800–1200 W/m$^{2}$° C.

8. An x-ray generating device as recited in claim 1, wherein adjustable positioning of said focal spot alignment path comprises positioning said focal spot alignment path in a linear direction along said longitudinal axis.

9. An x-ray generating device as recited in claim 1, wherein adjustable positioning of said focal spot alignment path comprises positioning said focal spot alignment path in a rotational direction about said longitudinal axis.

10. An x-ray generating device, comprising:

a vacuum vessel having an inner surface forming a vacuum chamber;

a cathode assembly, disposed within said vacuum chamber, for producing a stream of electrons;

an anode assembly comprising a target positionable for receiving said electrons at a focal spot resulting in generating x-rays, said x-rays directed out of said vacuum vessel along a focal alignment path;

a rotatable shaft fixedly attached to said target;

a support mechanism for supporting said shaft, said support mechanism having a proximal end and a distal end, said proximal end comprising a first housing and said distal end comprising a second housing, said first housing having an inner surface, said shaft rotatably mounted within said second housing at said distal end of said support mechanism, said support mechanism mounted within said vacuum vessel in a manner to provide adjustable positioning of said focal spot alignment path; and a cooling tube for channeling a cooling medium within said support mechanism, said cooling tube disposed adjacent to said support mechanism at said proximal end of said support mechanism, said cooling tube comprising an inner surface and an outer surface, said inner surface of said cooling tube forming an inlet chamber, said outer surface of said cooling tube in combination with said inner surface of said first chamber forming an outlet chamber, said inlet chamber and said outlet chamber in communication for allowing a flow of said cooling medium.

11. An x-ray generating device as recited in claim 10, wherein said proximal end of said support mechanism further comprises a cooling stem projecting within said first housing at said proximal end of said support mechanism, wherein said cooling stem comprises an outer surface, the combination of said outer surface of said cooling stem and said inner surface of said first housing forming an annular chamber.

12. An x-ray generating device as recited in claim 11, wherein said cooling tube is at least partially disposed within said first housing of said support mechanism, the combination of said inner surface of said first housing and said outer surface of said cooling tube forming an outlet chamber for receiving said cooling medium, said outlet chamber being in communication with said inlet chamber.

13. An x-ray generating device as recited in claim 12, wherein said inlet chamber, said outlet chamber and said cooling medium comprise a cooling system suitable to increase the heat dissipation capability of said support mechanism in the range of greater than 0% to about 30% above the heat dissipation capability of non-cooled anode x-ray devices.

14. An x-ray generating device as recited in claim 12, wherein said cooling stem projects within said inlet chamber.

15. An x-ray generating device as recited in claim 14, wherein said cooling stem and said inlet chamber are centered about said central, longitudinal axis.

16. An x-ray generating device as recited in claim 15, wherein said support mechanism provides adjustable positioning of said focal spot alignment path in a linear direction along said longitudinal axis.

17. An x-ray generating device as recited in claim 15, wherein said support mechanism provides adjustable positioning of said focal spot alignment path in a rotational direction about said longitudinal axis.

18. An x-ray system, comprising:

a casing comprising a wall having an inner surface and an outer surface, said outer surface removably attached to said x-ray system, said inner surface forming a vacuum chamber;

a support mechanism positioned within said vacuum chamber, said support mechanism having a proximal end and a distal end, said proximal end comprising a first housing and said distal end comprising a second housing, said first housing having an inner surface;

a bearing assembly fixedly disposed within said second housing at said distal end of said support mechanism, said bearing assembly comprising a lubricating medium;

a shaft rotatably mounted to said bearing assembly;

a target fixedly attached to said shaft, said target for receiving electrons at a focal spot resulting in generating x-rays, said x-rays directed along a focal alignment path;

a cooling tube for channeling a cooling medium within said support mechanism, said cooling tube fixedly disposed relative to said support mechanism, at least a portion of said cooling tube positioned within said first housing at said proximal end of said support mechanism, said cooling tube comprising an inner surface and an outer surface, said inner surface of said cooling tube forming an inlet chamber, said outer surface of said cooling tube in combination with said inner surface of said first chamber forming an outlet chamber, said inlet chamber and said outlet chamber in communication for allowing a flow of said cooling medium;

an inlet fixture for supplying said cooling medium, said inlet fixture disposed within said wall of said casing adjacent to said cooling tube, said inlet fixture directing at least a part of a flow of said cooling medium into said inlet chamber; and a mounting device for supporting said support mechanism and said cooling tube, said mounting device disposed within said vacuum chamber and fixedly attached to said casing, said mounting device attached to said support mechanism in a manner for adjustable positioning of said focal spot alignment path relative to said casing.

19. An x-ray system as recited in claim 18, wherein said support mechanism further comprises a cooling stem for increasing the surface area of said support mechanism, said cooling stem having an outer surface, said cooling stem disposed within said first housing at said proximal end, wherein an annular chamber is formed between said inner surface of said first housing and said outer surface of said cooling stem.

20. An x-ray system as recited in claim 19, wherein said cooling stem projects within said inlet chamber.

21. An x-ray system as recited in claim 20, wherein said inlet chamber, said outlet chamber and said cooling medium comprise a cooling system suitable to increase the heat dissipation capability of said support mechanism up to about 30% above the heat dissipation capability of non-anode cooled x-ray devices.

22. An x-ray system as recited in claim 20, wherein said x-ray system comprises a system selected from the group comprising vascular, fluoroscopy, angiography, radiography, mammography, computed tomography and mobile x-ray.

23. An x-ray generating device, comprising:

a target positioned for receiving electrons at a focal spot resulting in generating x-rays, said x-rays exiting said x-ray generating device along a focal spot alignment path;

a support mechanism having said target mounted thereon, said support mechanism disposed about a central, longitudinal axis and having a proximal end and a distal end, said proximal end having a cooling stem with an outer surface and a housing with an inner surface, said cooling stem centered about said central, longitudinal axis and projecting within an inlet chamber, said target rotatably mounted to said distal end, said support mechanism mounted within said x-ray generating device in a manner for adjustable positioning of said focal spot alignment path in a linear direction along said longitudinal axis and in a rotational direction about said longitudinal axis, the combination of said outer surface of said cooling stem and said inner surface of said housing forming an annular outlet chamber for receiving a cooling medium; and a cooling mechanism for channeling said cooling medium within said support mechanism, said cooling mechanism disposed adjacent to said proximal end of said support mechanism and at least partially disposed within said housing of said support mechanism, said cooling mechanism comprising a hollow portion having an outer surface and an inner surface, said inner surface forming said inlet chamber for receiving said cooling medium, said inlet chamber being centered about said central, longitudinal axis and in communication with said annular outlet chamber.

24. An x-ray generating device, comprising:

a vacuum vessel having an inner surface forming a vacuum chamber;

a cathode assembly, disposed within said vacuum chamber, for producing a stream of electrons;

an anode assembly comprising a target positionable for receiving said electrons at a focal spot resulting in generating x-rays, said x-rays directed out of said vacuum vessel along a focal spot alignment path;

a rotatable shaft fixedly attached to said target;

a support mechanism for supporting said shaft, said support mechanism having a proximal end and a distal end, said proximal end comprising a first housing having an inner surface, said distal end comprising a second housing, said shaft rotatably mounted within said second housing at said distal end of said support mechanism, said support mechanism mounted within said vacuum vessel in a manner to provide adjustable positioning of said focal spot alignment path in a linear direction along a central, longitudinal axis and in a rotational direction about said longitudinal axis; and a cooling tube for channeling a cooling medium within said support mechanism, said cooling tube being centered about said longitudinal axis, said cooling tube disposed adjacent to said support mechanism at said proximal end of said support mechanism and at least partially disposed within said first housing of said support mechanism, said cooling tube comprising an inner surface and an outer surface, said inner surface of said cooling tube forming an inlet chamber centered about said central, longitudinal axis, said outer surface of said cooling tube in combination with said inner surface of said first housing forming an outlet chamber, said inlet chamber and said outlet chamber being in communication for allowing a flow of said cooling medium.

25. An x-ray system, comprising:

a casing comprising a wall having an inner surface and an outer surface, said outer surface removably attached to said x-ray system, said inner surface forming a vacuum chamber;

a support mechanism positioned within said vacuum chamber, said support mechanism having a proximal end and a distal end, said proximal end comprising a first housing having an inner surface and said distal end comprising a second housing, said support mechanism further comprising a cooling stem having an outer surface for increasing the surface area of said support mechanism, said cooling stem disposed within an inlet chamber and within said first housing at said proximal end, wherein an annular outlet chamber is formed between said inner surface of said first housing and said outer surface of said cooling stem;

a bearing assembly fixedly disposed within said second housing at said distal end of said support mechanism, said bearing assembly comprising a lubricating medium;

a shaft rotatably mounted to said bearing assembly;

a target fixedly attached to said shaft, said target for receiving electrons at a focal spot resulting in generating x-rays, said x-rays directed along a focal alignment path;

a cooling tube for channeling a cooling medium within said support mechanism, said cooling tube fixedly disposed relative to said support mechanism, at least a portion of said cooling tube positioned within said first housing at said proximal end of said support mechanism, said cooling tube comprising an inner surface and an outer surface, said inner surface of said cooling tube forming said inlet chamber, said inlet chamber and said annular outlet chamber in communication for allowing a flow of said cooling medium, and said inlet chamber, said annular outlet chamber and said cooling medium comprising a cooling system suitable to increase the heat dissipation capability of said support mechanism up to about 30% above the heat dissipation capability of non-anode cooled x-ray devices;

an inlet fixture for supplying said cooling medium, said inlet fixture disposed within said wall of said casing adjacent to said cooling tube, said inlet fixture directing at least a part of a flow of said cooling medium into said inlet chamber; and a mounting device for supporting said support mechanism and said cooling tube, said mounting device disposed within said vacuum chamber and fixedly attached to said casing, said mounting device attached to said support mechanism in a manner for adjustable positioning of said focal spot alignment path relative to said casing.

26. An x-ray generating device, comprising:

a target having a focal spot for receiving electrons and generating x-rays along a focal spot alignment path;

a support mechanism having an adjustable mount and an axial bore, said adjustable mount for supporting said target relative to said x-ray generating device such that said focal spot alignment path is adjustably positionable relative to said x-ray generating device; and a hollow, tubular cooling mechanism at least partially disposed within said axial bore, said cooling mechanism having an inner surface and an outer surface, said inner surface forming an inlet chamber, a space between said axial bore and said outer surface forming an outlet chamber, wherein said inlet chamber and said outlet chamber are in communication for channeling a flow of a cooling medium.

27. The x-ray generating device of claim 26, wherein said support mechanism has a proximal end and a distal end, said proximal end comprises a cooling stem projecting within said inlet chamber.

28. The x-ray generating device of claim 26, wherein said outlet chamber comprises a thin-film flow channel.

29. The x-ray generating device of claim 26, wherein said inlet chamber, said outlet chamber and said cooling medium comprise a cooling system suitable to increase the heat dissipation capability of said support mechanism in the range of greater than 0% to about 30% above the heat dissipation capability of non-cooled anode x-ray devices.

30. The x-ray generating device of claim 26, wherein said hollow, tubular cooling mechanism is centered about a central, longitudinal axis.

31. The x-ray generating device of claim 26, wherein said inlet chamber is centered about a central, longitudinal axis.

32. The x-ray generating device of claim 26, wherein said support mechanism provides adjustable positioning of said focal spot alignment path in a linear direction along a central, longitudinal axis.

33. The x-ray generating device of claim 26, wherein said support mechanism provides adjustable positioning of said focal spot alignment path in a rotational direction about a central, longitudinal axis.

34. An x-ray generating device, comprising:

a target having a focal spot for receiving electrons and generating x-rays along a focal spot alignment path;

a support mechanism having an axial bore and a cooling stem projecting within said axial bore;

a hollow, tubular cooling mechanism at least partially disposed within said axial bore, wherein said cooling mechanism having an inner surface and an outer surface, said inner surface of said cooling mechanism forming an inlet chamber, a space between said axial bore and said outer surface of said cooling mechanism forming an outlet chamber, said inlet chamber and said outlet chamber being in communication for channeling a flow of a cooling medium; and wherein said support mechanism further comprises an adjustable mount, said adjustable mount for supporting said target relative to said x-ray generating device such that said focal spot alignment path is adjustably positionable relative to said x-ray generating device.

35. The x-ray generating device of claim 34, wherein said cooling stem also projects within said inlet chamber.

36. The x-ray generating device of claim 34, wherein said outlet chamber comprises a thin-film flow channel.

37. The x-ray generating device of claim 34, wherein said inlet chamber, said outlet chamber and said cooling medium comprise a cooling system suitable to increase the heat dissipation capability of said support mechanism in the range of greater than 0% to about 30% above the heat dissipation capability of non-cooled anode x-ray devices.

38. The x-ray generating device of claim 34, wherein said hollow, tubular cooling mechanism is centered about a central, longitudinal axis.

39. The x-ray generating device of claim 34, wherein said inlet chamber is centered about a central, longitudinal axis.

40. The x-ray generating device of claim 34, wherein said support mechanism provides adjustable positioning of said focal spot alignment path in a linear direction along a central, longitudinal axis.

41. The x-ray generating device of claim 34, wherein said support mechanism provides adjustable positioning of said focal spot alignment path in a rotational direction about a central, longitudinal axis.

* * * * *